US006203174B1

(12) United States Patent
Plumeyer

(10) Patent No.: US 6,203,174 B1
(45) Date of Patent: Mar. 20, 2001

(54) ACCESSORY REFLECTOR UNIT FOR REFLECTOR LAMPS AND ILLUMINATION SYSTEM USING THE REFLECTOR UNIT

(75) Inventor: Carsten Plumeyer, Poing (DE)

(73) Assignee: Patent-Treuhand-Gesellschaft F. Elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/301,056

(22) Filed: Apr. 28, 1999

(30) Foreign Application Priority Data

May 9, 1998 (DE) ..... 298 08 427 U

(51) Int. Cl.[7] ..... F21V 7/00

(52) U.S. Cl. ..... 362/277; 362/282; 362/301; 362/319; 362/322

(58) Field of Search ..... 362/282, 300, 362/301, 319, 322, 323, 354, 355, 277

(56) References Cited

U.S. PATENT DOCUMENTS

| | | | | |
|---|---|---|---|---|
| 320,494 | * | 7/1885 | Park | 362/319 |
| 373,219 | * | 11/1887 | Brehmer | 362/319 |
| 849,700 | * | 4/1907 | Schelb | 362/319 |
| 1,747,506 | | 2/1930 | Erksine | 362/297 |
| 2,673,926 | * | 3/1954 | Siringo | 362/322 |
| 2,785,293 | * | 3/1957 | Smith et al. | 362/323 |
| 4,536,828 | * | 8/1985 | Mori | 362/300 |
| 4,994,946 | * | 2/1991 | NakaMats | 362/282 |
| 5,430,630 | * | 7/1995 | Swarens et al. | 362/282 |
| 5,727,875 | * | 3/1998 | Huang | 362/301 |

FOREIGN PATENT DOCUMENTS 0 643 257 A1 3/1995 (EP) .

* cited by examiner

*Primary Examiner*—Sandra O'Shea
*Assistant Examiner*—Bertrand Zeade
(74) *Attorney, Agent, or Firm*—Frishauf, Holtz, Goodman, Langer & Chick, P.C.

(57) ABSTRACT

To permit change of direction of light emitted from a reflector lamp (3) adapted to be secured in a fixed socket, a reflector unit, preferably in the form of an attachment, is provided which is formed by a frame (2) which pivotably retains a partially light transparent and partially light reflecting disk (1). The frame (2) is coupled by a snap connection with a circumferential rim (3*a*) of the reflector lamp, so that the disk (1) is rotatable about the reflector axis (A) as well as pivotable in the arms (2). The reflector axis (A) and the pivot axis (P) of the disk preferably are perpendicular to each other. The disk may have a mirror reflective, and one matte surface, and can be made of plastic, aluminum, sheet steel and, if so, formed with openings (1*a*) therethrough; if made of glass, the surface can be partially light reflective/transmissive.

18 Claims, 2 Drawing Sheets

ACCESSORY REFLECTOR UNIT FOR REFLECTOR LAMPS AND ILLUMINATION SYSTEM USING THE REFLECTOR UNIT

FIELD OF THE INVENTION

The present invention relates to an accessory unit including a reflector for a reflector lamp which, typically, provides directed beams, and to an illumination system for a reflector lamp, usually a reflector lamp having an essentially circular reflector opening bounded by a rim, using and in combination with the reflector unit for selective direction of the illumination provided by the lamp.

BACKGROUND OF THE INVENTION

Commercial reflector lamps used singly or in combination with lamp strips are usually fitted in fixed lamp sockets which cannot be shifted in position. These sockets are then supplied with the reflector lamps. Due to the fixed position of the socket, it is not possible to direct the light in a desired direction, rather than the direction provided by the socket, for example perpendicularly downwardly. Lighting strips of this type are frequently used in connection with merchandise displays which may be rearranged and thus will not always be optimally lighted by the lamps in the light strip.

THE INVENTION

It is an object to provide a reflector unit for reflector lamps which permits change in the direction of the emitted light beams from the direction determined by the lamp socket. The reflection unit, additionally, should be independent of the construction of the lamp, the entire lighting unit or array, or luminaire, using the reflector lamp.

Briefly, the reflector unit is preferably formed as an attachment for a reflector lamp. The lamp defines a lamp axis. The unit has a light reflecting disk and a frame which retains the disk. The frame has two holding arms which pivotably retain the disk to permit pivoting about a pivot axis. The frame further has coupling elements to rotatably couple the frame to the lamp for rotation about the reflector axis. Preferably, the pivot axis and the lamp axis are at right angles to each other.

The reflector unit for the reflector lamps, thus, can form an accessory which has a light reflecting disk and a frame. The coupling elements, which form attachment elements to attach the frame to the lamp at the same time permit rotation of the frame and the light reflecting disk attached thereto about the lamp, or reflector axis.

The light reflecting disk, pivotable about the pivot axis in the frame, can thus vary the direction of emitted light from the reflector lamp. The disk, thus, is positionable about the reflector axis and about the pivot axis which, preferably, is perpendicular to the reflector axis. Since the unit has the coupling means for coupling the unit to the reflector lamp, the entire unit can be directly attached to the outside of the reflector of the reflector lamp. The reflector unit can thus be made and designed entirely independently of the construction and arrangement of the light strip, or luminaire, in which the reflector lamps are inserted, or intended to be used.

Preferably, the coupling means are a ring-shaped flange with at least two snap hooks formed thereon. The diameter of the flange is matched to the diameter, that is, the light exit opening of the reflector of the reflector lamp. The ring-shaped flange and the snap hooks permit easy attachment and coupling of the unit to the lamp, so that the light reflecting disk is reliably and securely retained on the lamp. The light reflecting disk preferably has light transmissive regions. The light transmissive regions, preferably centrally of the disk, prevent formation of shadows in axial direction of the reflector lamp or, at least, largely reduce such shadows.

The light reflecting disk preferably has a first, mirrored surface and a second surface opposite thereto which can be matte, that is, light diffusing. In dependence on the surface facing the reflector lamp, it is thus possible to direct a cone or beam of light in accordance with the pivoting and rotation of the disk, or a spread, diffusely reflected light. The light reflecting disk preferably is made either of glass or of an opaque, i.e. light blocking material, such as a plastic, aluminum, sheet steel or the like. If an opaque element is used, the disk is preferably formed with one or more transparent openings. If the disk is made of glass, one of its surfaces preferably is coated with a partially light permeable mirror.

The various arrangements and variations possible for the light reflecting disk permit splitting of the light emitted by the reflector lamp into a light beam which passes through the transparent regions of the disk and another light beam reflected from the light reflecting portions of the disk.

The illumination system, in accordance with the present invention, has at least one reflector lamp and the reflector unit, as described above, attached thereto. The reflector of the reflector lamp of the system usually has a ring-shaped circumferential projecting ring, to which the reflection unit can be so attached that it is rotatable about the reflector axis. The projecting rim of the reflector lamp and the ring-shaped flange of the reflector unit with the snap hooks formed thereon form an inter-engaging snapover coupling. The illumination system preferably uses an arrangement in which the pivot axis of the light reflecting disk is perpendicular to the light emission axis from the reflector of the at least one reflector lamp.

DETAILED DESCRIPTION

Figure 1:
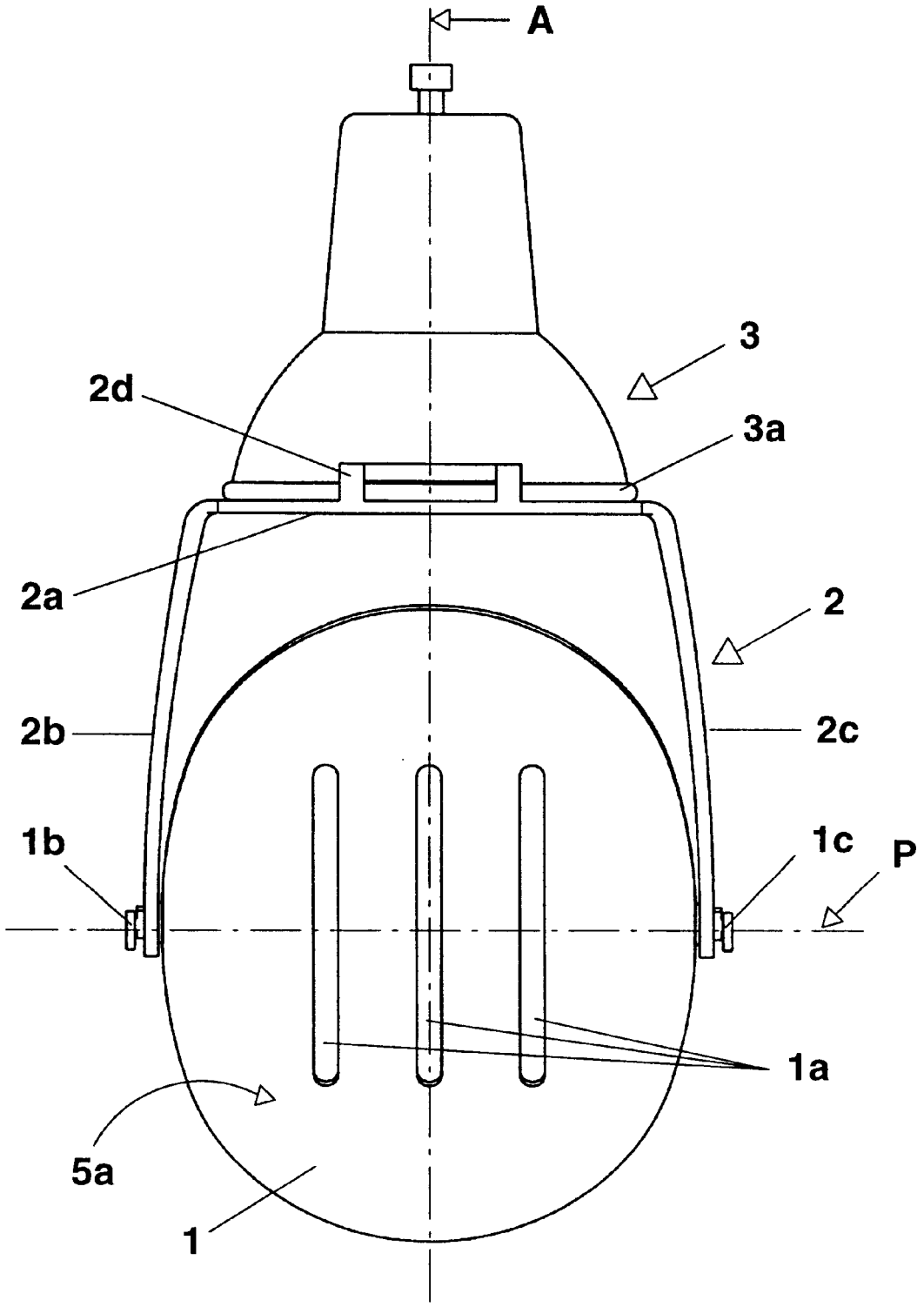
FIG. 1 is a side view of the reflection unit coupled to a reflector lamp shown only schematically.
Figure 2:
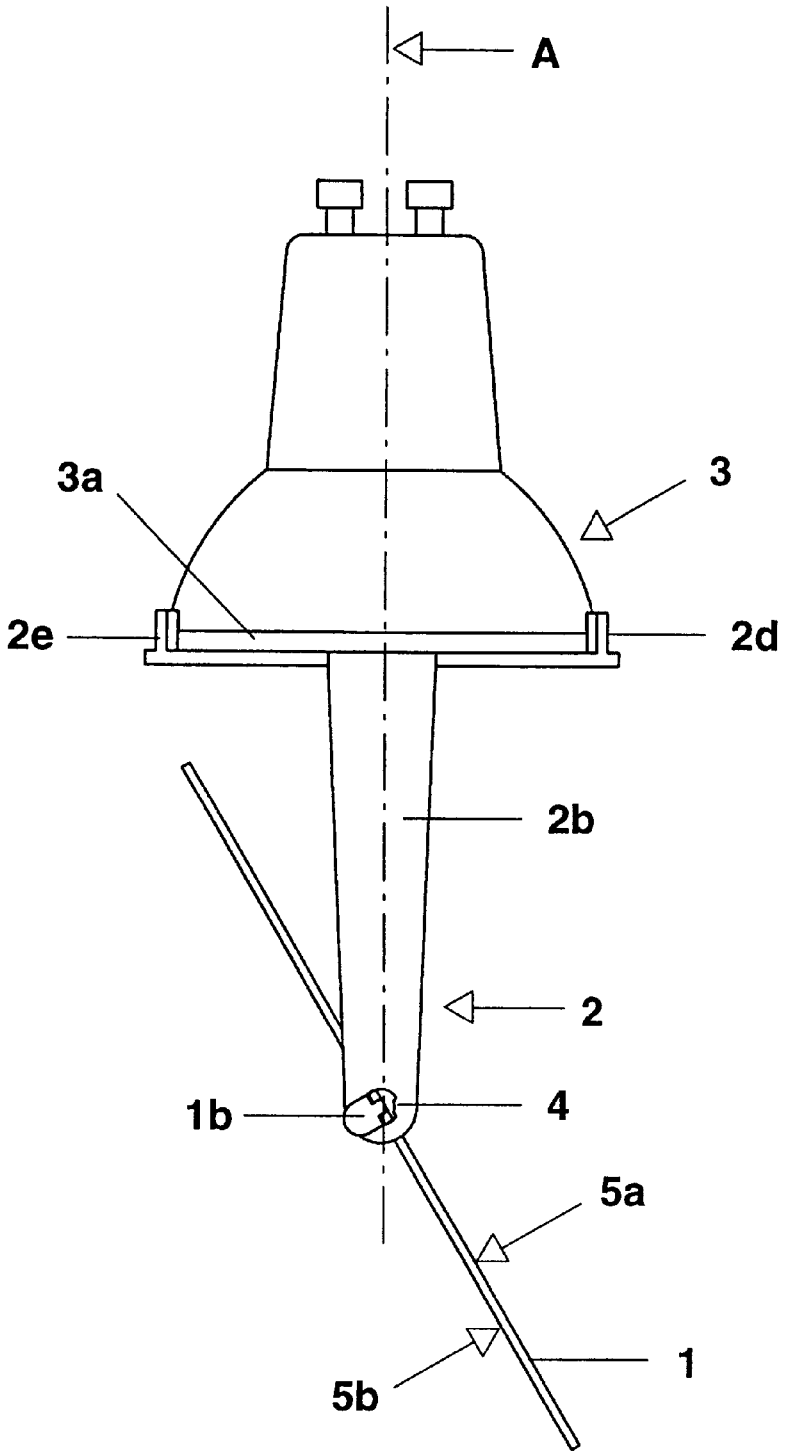
FIG. 2 is an illustration of the unit of FIG. 1, rotated by 90° with respect to FIG. 1 and illustrating the reflector unit coupled to a reflector lamp.

The reflector unit shown in FIGS. 1 and 2 has a generally oval disk 1, made of sheet aluminum, having a thickness of about 1 mm. The disk 1 is retained in a frame 2 made of plastic. The disk 1 is formed with three centrally located light transparent slits 1*a,* extending parallel to the larger half axis of the oval disk 1. One surface 5*a* is formed as a mirror and is reflective, whereas the opposite surface 5*b* is matte, so that light impinging thereon will be diffusely directed. The disk is formed at both sides with tabs 1*b,* 1*c,* located at the small axis of the oval. The tabs 1*b,* 1*c* engage in an opening formed in the frame 2, and thereby retain the disk 1, pivotable about a pivot axis P (FIG. 1) transverse to the lamp axis A.

The frame 2 has a ring-shaped flange 2*a,* the diameter of which is matched to the diameter of the reflector opening of the reflector lamp 3. It has two integrally formed, diametrically located arms 2*b,* 2*c* to retain the disk 1, and, further, two integrally formed coupling hooks 2*d,* 2*e* adapted to snap over the rim at the outside end of the reflector of the lamp 3. The reflector of the reflector lamp 3, as is customary in such lamps, has a ring-shaped projecting circumferential collar 3*a*. The snapover hooks 2*d*, 2*e* of the frame 2, upon assembly, snap over the rim. The ring-shaped flange 2*a*, after assembly to the lamp, is located in the region of the reflector light exit opening and engages the reflector of the reflector lamp 3, without essentially blocking any light. The frame 2 and the disk 1 secured thereto thus are rotatable about the lamp, the position of which may be fixed in a lamp socket. Upon rotation of the frame 2 about the reflector axis A, the snapover hooks 2*d*, 2*e* slide on the projecting collar 3*a*, without loosening of the snap connection between the collar 3*a* and the snapover hooks 2*d*, 2*e*.

The two carrying arms 2*b*, 2*c* extend at an angle from the flange 2*a*, and project essentially perpendicularly with respect to a plane of the flange 2*a*. The free ends of the arms 2*b*, 2*c* are each formed with an opening 4, in which the tabs 1*b*, 1*c* of the disk 1 engage. The form and shape of this opening 4 is so matched to the shape and form of the tabs 1*b*, 1*c* that the disk can be pivoted about its smaller half axis over a maximum angle of about 90°. The pivot angle of pivoting of disk 1 can be limited by forming the openings 4 for the tabs 1*b*, 1*c* in the frame arms 2*b*, 2*c* in elongated form, so that the tabs cannot tip beyond predetermined angles with respect to the elongated hole 1, see FIG. 2. That means that the disk can be pivoted about an angle of about −45° to approximately +45° with respect to the arms 2*b*, 2*c*. The arms 2*b*, 2*c* can also be formed with stops in order to limit the pivot movement. It is thus not possible to position the disk parallel to the flange 2*a*, and light emitted from the reflector lamp 3 cannot be reflected back into the lamp. The pivot axis P of the disk 1 extends parallel to the plane of the circular flange 2*a*, and perpendicular to the axis A of the reflector of the lamp 3 due to the openings 4 formed in the arms 2*b*, 2*c*.

A portion of the light emitted by the reflector lamp 3 passes through the three slits 1*a* without being blocked, and thus is not influenced by the disk 1. Another portion of the light from the lamp 3 is reflected. The light is bundled into a beam in dependence on the pivot angle from the reflecting surface 5*a* of the lamp 1 and reflected in a predetermined direction in dependence on the position of the disk 1. If the disk 1 is changed from the position shown in FIG. 2 so that the surface 5*b* is opposite the beam emitted from the lamp, diffusely reflected light can be obtained when the surface 5*b* is a matte surface. Thus, the user can select two different illumination functions in accordance with desired purposes.

The reflection unit can be easily integrated into an illuminating system. Such an illuminating system, for example, is formed by a light strip having a plurality, for example three fixed lamp sockets, each one adapted to receive a reflector lamp. The lamp sockets are so positioned that the reflector lamps radiate their light in a predetermined direction, for example downwardly. For each of the reflector lamps, a reflection unit, which can be an accessory in accordance with the above-described example, can be used. Selectively, in accordance with the desire of the user, one or more reflection lamps can be fitted with such accessory units, and by suitably positioning of the disk 1, and selecting the surface 5*a* or 5*b* for impingement by the light from the respective lamps, light from the reflector lamps can be laterally deflected in the direction selected by the user, or essentially directed downwardly if the disk is positioned congruent with the lamp axis A, with minimum light attenuation.

Various changes and modification may be made, and the disk itself can be made in many different ways. For example, rather than using aluminum for the disk 1, sheet steel may be used, or plastic, or glass. The disk 1 may have other openings than the slits 1*a* as shown, and may have light transmissive locations as selected. If the disk 1 is made of glass, or other essentially transparent material, the disk 1 need not have the openings 1*a* but, selectively, can be formed on one side with a partially light transparent—reflective layer. The partial light transparency of the light reflective disk 1 is not a requirement. Likewise, the frame 2 may be made of metal, rather than of plastic.

Other changes and modifications may be made within the scope of the inventive concept.

What is claimed is:

1. Reflector unit for combination with, and attachment to a reflector lamp (3) defining a reflector axis (A), said reflector unit comprising:

a light reflecting disk (1); and a frame (2) having holding arms (2*b*, 2*c*) pivotably retaining said light reflecting disk, said light reflecting disk being pivotable about a pivot axis (P), said frame further having coupling means for rotatably retaining the frame on the lamp (3) for rotation about said reflector axis (A), and relative to said pivot axis (P), wherein the coupling means comprises a ring-shaped flange (2*a*) and at least two engagement projections (2*d*, 2*e*) formed on the ring-shaped flange (2*a*), the diameter of the ring-shaped flange being matched to a reflector light exit opening of the reflector lamp (3) with which the reflector unit is to be used.

2. The unit of claim 1, wherein said light reflecting disk (1) has one or more light permeable regions (1*a*).

3. The unit of claim 1, for combination with a reflector lamp having an at least partially circumferentially extending rim (3*a*); and wherein the engagement projections comprise snap hooks (2*d*, 2*e*) fitting over said rim.

4. The unit of claim 1, wherein the light reflecting disk (1) has a first, reflective surface (5*a*), and a second matte, light diffusing surface (5*b*).

5. The unit of claim 1, wherein said light reflecting disk (1) is made of opaque, light blocking material and is formed with one or more openings (1*a*) therein permitting light to pass through the disk.

6. The unit of claim 1, wherein said light reflecting disk (1) is formed of at least one of the materials selected from the group consisting of plastic, aluminum, sheet steel.

7. The unit of claim 1, wherein said light reflecting disk (1) is made of glass.

8. The unit of claim 7, wherein one surface of said light reflecting disk is formed with a partially light permeable mirror.

9. The unit of claim 1, wherein said pivot axis (P) and said reflector axis (A) are at right angles to each other.

10. An illumination system comprising:

at least one reflector lamp (3); and a reflector unit (1, 2) as claimed in claim 1, the reflector unit being attached to said at least one reflector lamp;

wherein said at least one reflector lamp has an essentially ring-shaped circumferential rim (3*a*), and the reflector unit (1, 2) is rotatably secured to the rim (3*a*), for rotation about the reflector axis (A) of the reflector unit, and wherein the frame (2) of the reflector unit (1, 2) has a ring-shaped flange formed with at least two snap hooks thereon, said ring-shaped flange engaging the reflector, and the snap hooks being snapped over the rim (3*a*) of said at least one reflector lamp to form a snap-engagement coupling therewith.

11. The system of claim 10, wherein the reflector axis (A) and the pivot axis (P) of the disk are perpendicular with respect to each other.

12. The system of claim 10, wherein said light reflecting disk (1) has one or more light permeable regions (1*a*).

13. The system of claim 10, for combination with a reflector lamp having an at least partially circumferentially extending rim (3); and wherein the engagement projections comprise snap hooks (2*d*, 2*e*) fitting over said rim.

14. The system of claim 10, wherein said light reflecting disk (1) is made of opaque, light blocking material and is formed with one or more openings (1*a*) therein permitting light to pass through the disk.

15. The system of claim 10, wherein said light reflecting disk (1) is formed of at least one of the materials selected from the group consisting of plastic, aluminum, sheet steel.

16. The system of claim 10, wherein said light reflecting disk (1) is made of glass.

17. The system of claim 16, wherein one surface of said light reflecting disk is formed with a partially light permeable mirror.

18. The system of claim 10, further including:

pivot elements (1*b*, 1*c*) between said light reflecting disk (1) and said arms (2*b*, 2*c*) of the frame; and limit means for limiting the pivot angle of pivoting of said light reflecting disk with respect to said arms.

* * * * *